US007434520B2

(12) United States Patent
Zupancich et al.

(10) Patent No.: US 7,434,520 B2
(45) Date of Patent: Oct. 14, 2008

(54) INSULATED CARGO CONTAINER DOORS

(75) Inventors: Ronald J. Zupancich, Clayton, NC (US); Joseph A. Seiter, Raleigh, NC (US)

(73) Assignee: Martin Marietta Materials, Inc., Raleigh, NC (US)

( * ) Notice: Subject to any disclaimer, the term of this patent is extended or adjusted under 35 U.S.C. 154(b) by 255 days.

(21) Appl. No.: 11/104,089

(22) Filed: Apr. 12, 2005

(65) Prior Publication Data

US 2005/0252913 A1 Nov. 17, 2005

Related U.S. Application Data

(60) Provisional application No. 60/560,963, filed on Apr. 12, 2004.

(51) Int. Cl.
*B61D 17/00* (2006.01)

(52) U.S. Cl. ..... 105/423; 105/404; 105/355; 312/405

(58) Field of Classification Search ..... 105/355, 105/404, 423; 220/1.5, 1.6, 592.02, 592.01; 312/405; 49/219, 220
See application file for complete search history.

(56) References Cited

U.S. PATENT DOCUMENTS

| | | | | |
|---|---|---|---|---|
| 739,800 | A | | 9/1903 | Adams |
| 905,000 | A | | 11/1908 | Roberts |
| 1,127,451 | A | | 2/1915 | Knoch |
| 1,269,663 | A | | 6/1918 | Wappler |
| 2,612,659 | A | * | 10/1952 | O'Connor ..... 49/212 |
| 3,711,148 | A | | 1/1973 | Hindin |
| 3,715,846 | A | | 2/1973 | Sullhofer |
| 3,739,526 | A | | 6/1973 | Nelson |
| 3,790,243 | A | * | 2/1974 | Whorton, III ..... 312/405 |
| 3,797,190 | A | | 3/1974 | Widdowson |
| 3,802,591 | A | | 4/1974 | Mizushima et al. |
| 3,880,415 | A | | 4/1975 | Fujioka et al. |
| 3,962,015 | A | | 6/1976 | Heimann |
| 3,974,781 | A | | 8/1976 | Josephson |
| 3,993,811 | A | | 11/1976 | Walles |
| 4,049,311 | A | | 9/1977 | Dietrich et al. |
| 4,078,395 | A | | 3/1978 | Crowe et al. |
| 4,091,743 | A | | 5/1978 | Lemon |

(Continued)

FOREIGN PATENT DOCUMENTS

EP 0 006 443 A1 9/1980

(Continued)

OTHER PUBLICATIONS

"Qualification Testing of Portland's Low Floor Light Rail Vehicle", Porter, D.L. et al., Proceedings of the 1997 IEEE/ASME Joint Railroad Conference, p. 221-35 (1997).

(Continued)

*Primary Examiner*—Mark T Le
(74) *Attorney, Agent, or Firm*—Finnegan, Henderson, Farabow, Garrett & Dunner, L.L.P.

(57) ABSTRACT

A method to insulate an existing door for an existing cargo container, such as a boxcar. In one implementation, the method includes attaching a liner to at least one surface of the door, incorporating an insulating layer, and attaching a gasket to the liner. A door retrofit by this method will have improved thermal efficiency.

11 Claims, 9 Drawing Sheets

U.S. PATENT DOCUMENTS

| | | | | |
|---|---|---|---|---|
| 4,134,626 | A * | 1/1979 | Kordes | 312/405 |
| 4,151,802 | A | 5/1979 | Miller et al. | |
| 4,221,421 | A | 9/1980 | Bettker, Jr. et al. | |
| 4,239,008 | A | 12/1980 | Conlon | |
| 4,263,751 | A | 4/1981 | Bennett et al. | |
| 4,296,692 | A | 10/1981 | Roux | |
| 4,302,913 | A | 12/1981 | Schwartz et al. | |
| 4,310,192 | A | 1/1982 | Fitzgerald | |
| 4,344,299 | A | 8/1982 | Latzer | |
| 4,357,048 | A | 11/1982 | Zehnder et al. | |
| 4,406,131 | A | 9/1983 | Weasel, Jr. | |
| 4,434,623 | A | 3/1984 | Weasel, Jr. | |
| 4,448,041 | A | 5/1984 | Southworth, Jr. | |
| 4,454,723 | A | 6/1984 | Weasel, Jr. | |
| 4,455,806 | A | 6/1984 | Rice | |
| 4,498,418 | A | 2/1985 | Chumley | |
| 4,569,292 | A | 2/1986 | Dunham et al. | |
| 4,570,396 | A | 2/1986 | Struben | |
| 4,631,891 | A | 12/1986 | Donavich | |
| 4,646,934 | A | 3/1987 | McAllister | |
| 4,682,458 | A | 7/1987 | Sparrow | |
| 4,704,876 | A | 11/1987 | Hill | |
| 4,763,452 | A | 8/1988 | Harvey | |
| 4,778,078 | A | 10/1988 | McAllister | |
| 4,791,768 | A | 12/1988 | Crean | |
| 4,884,496 | A | 12/1989 | Donavich | |
| 4,887,437 | A | 12/1989 | Fenton et al. | |
| 4,891,954 | A | 1/1990 | Thomsen | |
| 4,918,895 | A | 4/1990 | Landheer | |
| 4,958,472 | A | 9/1990 | Ehrlich | |
| 5,010,943 | A | 4/1991 | Boyer | |
| 5,011,729 | A | 4/1991 | McAllister | |
| 5,016,395 | A | 5/1991 | Walker et al. | |
| 5,054,402 | A | 10/1991 | Brassell | |
| 5,054,843 | A | 10/1991 | Gray | |
| 5,168,717 | A | 12/1992 | Mowatt-Larssen | |
| 5,170,605 | A | 12/1992 | Huddle | |
| 5,285,604 | A | 2/1994 | Carlin | |
| 5,316,171 | A | 5/1994 | Danner, Jr. et al. | |
| 5,351,990 | A | 10/1994 | Thomas | |
| 5,403,063 | A | 4/1995 | Sjostedt et al. | |
| 5,473,901 | A | 12/1995 | Roseen | |
| 5,500,305 | A | 3/1996 | Bridges et al. | |
| 5,507,405 | A | 4/1996 | Thomas et al. | |
| 5,512,345 | A | 4/1996 | Tsutsumi et al. | |
| 5,584,188 | A | 12/1996 | Tippmann et al. | |
| 5,660,057 | A | 8/1997 | Tyree, Jr. | |
| 5,664,396 | A | 9/1997 | Lyman et al. | |
| 5,671,609 | A | 9/1997 | Lionetti | |
| 5,711,073 | A | 1/1998 | Tippmann et al. | |
| 5,756,179 | A | 5/1998 | Jutte | |
| 5,765,485 | A | 6/1998 | Thoman et al. | |
| 5,772,276 | A | 6/1998 | Fetz et al. | |
| 5,784,970 | A | 7/1998 | Fehr et al. | |
| 5,795,639 | A | 8/1998 | Lin | |
| 5,797,646 | A | 8/1998 | Jeunehomme et al. | |
| 5,802,984 | A | 9/1998 | Thoman et al. | |
| 5,855,174 | A | 1/1999 | Thoman et al. | |
| 5,857,414 | A | 1/1999 | Thoman et al. | |
| 5,890,435 | A | 4/1999 | Thoman et al. | |
| 5,900,299 | A | 5/1999 | Wynne | |
| 5,916,093 | A | 6/1999 | Fecko et al. | |
| 5,927,090 | A | 7/1999 | Ladendorf et al. | |
| 5,934,741 | A | 8/1999 | Beukers et al. | |
| 5,938,274 | A | 8/1999 | Ehrlich | |
| 5,947,812 | A | 9/1999 | Henning et al. | |
| 5,979,173 | A | 11/1999 | Tyree | |
| 5,979,684 | A | 11/1999 | Ohnishi et al. | |
| 5,988,074 | A | 11/1999 | Thoman | |
| 5,992,117 | A | 11/1999 | Schmidt | |
| 6,000,342 | A | 12/1999 | Thoman et al. | |
| 6,010,020 | A | 1/2000 | Abal | |
| 6,037,033 | A | 3/2000 | Hunter | |
| 6,092,472 | A | 7/2000 | Thoman et al. | |
| 6,119,422 | A | 9/2000 | Clear et al. | |
| 6,132,307 | A | 10/2000 | Wills | |
| 6,138,580 | A | 10/2000 | Thoman | |
| 6,199,939 | B1 | 3/2001 | Ehrlich | |
| 6,220,651 | B1 | 4/2001 | Ehrlich | |
| 6,224,142 | B1 | 5/2001 | McCormack | |
| 6,244,458 | B1 | 6/2001 | Frysinger et al. | |
| 6,266,972 | B1 | 7/2001 | Bostic | |
| 6,269,652 | B1 | 8/2001 | Grosskopf | |
| 6,349,988 | B1 | 2/2002 | Foster et al. | |
| 6,367,391 | B1 | 4/2002 | Thoman et al. | |
| 6,374,546 | B1 | 4/2002 | Fecko et al. | |
| 6,381,966 | B1 | 5/2002 | Barrow | |
| 6,381,981 | B1 | 5/2002 | Yaddgo et al. | |
| 6,397,620 | B1 | 6/2002 | Kelly et al. | |
| 6,454,345 | B1 | 9/2002 | Campus | |
| 6,503,037 | B2 | 1/2003 | Thomson et al. | |
| 6,505,883 | B1 | 1/2003 | Ehrlich | |
| 6,550,255 | B2 | 4/2003 | Rudick et al. | |
| 6,575,102 | B2 * | 6/2003 | Norton et al. | 105/423 |
| 6,615,741 | B2 | 9/2003 | Fecko et al. | |
| 6,623,413 | B1 | 9/2003 | Wynne | |
| 6,722,287 | B2 | 4/2004 | Norton et al. | |
| 7,305,923 | B2 | 12/2007 | Creighton et al. | |
| 2001/0011832 | A1 | 8/2001 | Ehrlich et al. | |
| 2002/0020129 | A1 | 2/2002 | Winter | |
| 2002/0062611 | A1 | 5/2002 | Pryor et al. | |
| 2002/0114937 | A1 | 8/2002 | Albert et al. | |
| 2002/0134088 | A1 | 9/2002 | Rudick et al. | |
| 2002/0144482 | A1 | 10/2002 | Henson et al. | |
| 2002/0148181 | A1 | 10/2002 | Friesner | |
| 2002/0148196 | A1 | 10/2002 | Barry et al. | |
| 2002/0148381 | A1 | 10/2002 | Norton et al. | |
| 2002/0157565 | A1 | 10/2002 | Norton et al. | |
| 2002/0170238 | A1 | 11/2002 | Fecko et al. | |
| 2002/0185880 | A1 | 12/2002 | Miller | |
| 2003/0041981 | A1 | 3/2003 | Cramer, III | |
| 2003/0056456 | A1 | 3/2003 | Heydon | |
| 2003/0159404 | A1 | 8/2003 | Chang | |
| 2003/0203149 | A1 | 10/2003 | Allen et al. | |
| 2004/0020236 | A1 | 2/2004 | Vince, II et al. | |

FOREIGN PATENT DOCUMENTS

| | | | |
|---|---|---|---|
| EP | 0 052 982 | A2 | 6/1982 |
| EP | 0 075 913 | A2 | 4/1983 |
| EP | 0 330 293 | A2 | 8/1989 |
| EP | 0 375 621 | A1 | 12/1989 |
| EP | 0 358 638 | B1 | 3/1990 |
| EP | 0 490 073 | B1 | 12/1990 |
| EP | 0 463 980 | B1 | 11/1992 |
| EP | 0 514 014 | B1 | 11/1992 |
| EP | 0 544 361 | B1 | 6/1993 |
| EP | 0 589 033 | B1 | 3/1994 |
| EP | 0 739 800 | A1 | 10/1996 |
| EP | 0 753 422 | B1 | 1/1997 |
| EP | 0 904 228 | B1 | 3/1999 |
| EP | 0 905 000 | A1 | 3/1999 |
| EP | 0 962 343 | A2 | 12/1999 |
| EP | 0 967 116 | A2 | 12/1999 |
| EP | 1 219 484 | A2 | 7/2002 |
| EP | 1 288 112 | A1 | 3/2003 |
| JP | 55135294 | | 10/1980 |
| JP | 1127451 | | 5/1989 |
| JP | 1269663 | | 10/1989 |
| JP | 9048369 | | 2/1997 |
| JP | 10-147262 | | 6/1998 |
| JP | 10-258777 | | 9/1998 |
| JP | 10-258779 | | 9/1998 |
| JP | 10258778 | | 9/1998 |

| | | |
|---|---|---|
| JP | 11-210106 | 8/1999 |
| JP | 2000-052982 | 2/2000 |
| JP | 2000-081266 | 3/2000 |
| JP | 2001263897 | 9/2001 |
| JP | 2002-264717 | 9/2002 |
| WO | WO99/10220 | 3/1999 |
| WO | WO99/12787 | 3/1999 |
| WO | WO 0006443 | 2/2000 |
| WO | WO 2004/071885 | 8/2004 |

OTHER PUBLICATIONS

"Fiberglass Reinforced Foam Core Sandwich Panel for Use as Refrigerated Semi-Trailer Side Walls and Roofs", Edford, Allan S., SAE Technical Papers, 820991, (1982).

U.S. Appl. No. 11/072,293, filed Mar. 7, 2005, Zupancich et al.

U.S. Appl. No. 10/957,729, filed Oct. 5, 2004, Seiter.

* cited by examiner

INSULATED CARGO CONTAINER DOORS

CROSS-REFERENCE TO RELATED APPLICATION

This application claims the benefit of U.S. Provisional Application No. 60/560,963, filed Apr. 12, 2004, by Ronald J. Zupancich and Joseph A. Seiter and titled Insulated Cargo Container Doors, the disclosure of which is expressly incorporated herein by reference.

BACKGROUND

A. Technical Field

The present invention relates to an insulated door for a cargo container and an insulated cargo container containing such a door. In one embodiment, the insulated door is an insulated door for a railroad boxcar.

B. Related Art

Currently, many shippers utilize insulated or refrigerated large cargo containers (such as boxcars) to transport items that require the maintenance of specified temperatures during transit. Because these containers are required to maintain certain temperatures, the thermal efficiency of these containers is an important feature. Thermal efficiency is characterized by the thermal conductivity of a particular component or its inverse, its resistance to heat transfer commonly referred to as an R value.

One area of heat loss in these containers is in the area of the door. In the past, cargo container doors were typically constructed of a combination of wood and metal members. Because members of this type typically possessed a low R-value, insulation, such as foam insulation, was often installed in these cargo container doors to increase their thermal efficiency. Even with the use of insulation, however, the thermal efficiency of cargo container doors of this type has not been as high as desired by users of these cargo containers. One reason for this lack of thermal efficiency is that it is generally impractical to make a piece of foam insulation to match the dimensions of the door. Therefore, several separate pieces of foam must be used. Typically, these foam pieces are adhered together and applied to the door. The bond lines of these pieces, however, form thermal shorts, that is, areas in the door which allow heat loss to bypass insulation, thereby causing a reduction in thermal efficiency. A method to insulate an existing door for an existing cargo container, such as a boxcar. In one implementation, the method includes attaching a liner to at least one surface of the door, incorporating an insulating layer, and attaching a gasket to the liner. A door retrofit by this method will have improved thermal efficiency. A method to insulate an existing door for an existing cargo container, such as a boxcar. In one implementation, the method includes attaching a liner to at least one surface of the door, incorporating an insulating layer, and attaching a gasket to the liner. A door retrofit by this method will have improved thermal efficiency.

In addition, current cargo container doors often include thermal shorts, at other areas of the door causing a further reduction in thermal efficiency. One common area for thermal shorts is near the edges of the door where little or no insulation is included. Therefore, there is a need for a cargo container door constructed to improve thermal efficiency and that also removes potential thermal shorts. The present invention provides a cargo container door that meets these needs.

II. SUMMARY OF THE INVENTION

An apparatus consistent with the present invention provides an insulated door for a boxcar. The insulated door comprises a door; a liner comprising composite materials and having a first surface and a second surface opposing the first surface, wherein the liner is located on a surface of the door and at least partially covers the surface of the door, and wherein the first surface of the liner is facing the door; an insulating layer located between the first surface of the liner and the door; and a gasket located on the perimeter of the second surface of the liner.

Apparatus consistent with present invention also provide a boxcar. The boxcar comprises an enclosure for transporting cargo, the enclosure including an opening to provide access to the enclosure; a door jamb located on the perimeter of the opening; and an insulated door located in the opening to cover or reveal the opening. The insulated door comprising a door having an interior surface facing the enclosure; a liner comprising composite materials and having a first surface and a second surface opposing the first surface, wherein the liner is located on the interior surface of the door and at least partially covers the interior surface of the door, and wherein the first surface of the liner is facing the interior surface of the door; an insulating layer located between the first surface of the liner and the interior surface of the door; and a gasket located on the perimeter of the second surface of the liner.

Another apparatus consistent with present invention provides a boxcar comprising an enclosure for transporting cargo, the enclosure including an opening to provide access to the enclosure; a door jamb located on the perimeter of the opening, and an insulated door located in the opening to cover or reveal the opening. The door jamb comprises two vertically aligned side members located on opposing sides of the perimeter of the opening; a horizontally aligned top member located on a top side of the perimeter of the opening; and a horizontally aligned bottom member located on a bottom side of the perimeter of the opening, the bottom member comprising a wedge shaped portion. The insulated door comprises a door having an interior surface facing the enclosure; a liner comprising composite materials and having a first surface and a second surface opposing the first surface, wherein the liner is located on the interior surface of the door and substantially covers the interior surface of the door, wherein the first surface of the liner is facing the interior surface of the door; and wherein the liner comprises a wedge-shaped portion forming the bottom edge of the liner and designed to mate with the wedge-shaped portion on the door jamb to create a thermal break; an insulating layer located between the first surface of the liner and the interior surface of the door; and a gasket located on the perimeter of the second surface of the liner.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE EMBODIMENTS

A. Introduction

As described below, apparatus consistent with the present invention will now be described with respect to one embodiment of an insulated door for a cargo container: an insulated door for a boxcar. The invention as claimed, however, is broader than insulated doors for boxcars and extends to insulated doors for other large insulated cargo containers, such as, shipping containers used on seagoing container vessels, truck trailers, straight trucks, refrigerated buildings, or the like.

B. Apparatus

FIGS. 1-4 illustrate four views of an insulated door consistent with one embodiment of the invention. As shown in FIGS. 1-4, in one implementation, an insulated door 100 includes a liner 110, a gasket 120, and a door 140 (not shown in FIGS. 1-3, but shown in FIG. 4). As shown in FIGS. 1-4, liner 110 is attached to a surface of door 140 partially surrounding door 140, and gasket 120 is attached to the perimeter of the interior surface of liner 110. Door 140, liner 110, and gasket 120 are described in detail below. This implementation is merely exemplary and other implementations may also be used.

Figure 1:
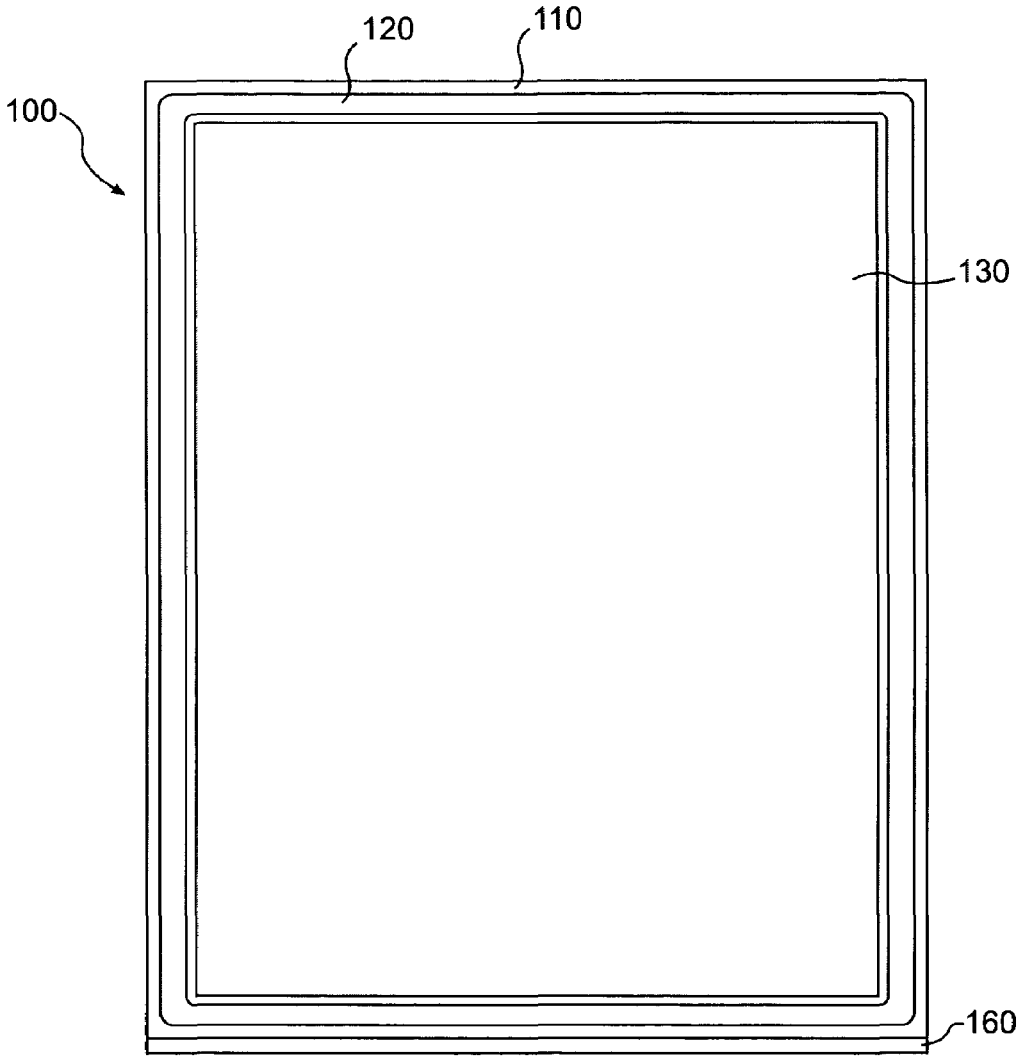
FIG. 1 is a front view of an insulated door consistent with one embodiment of the invention.
Figure 2:
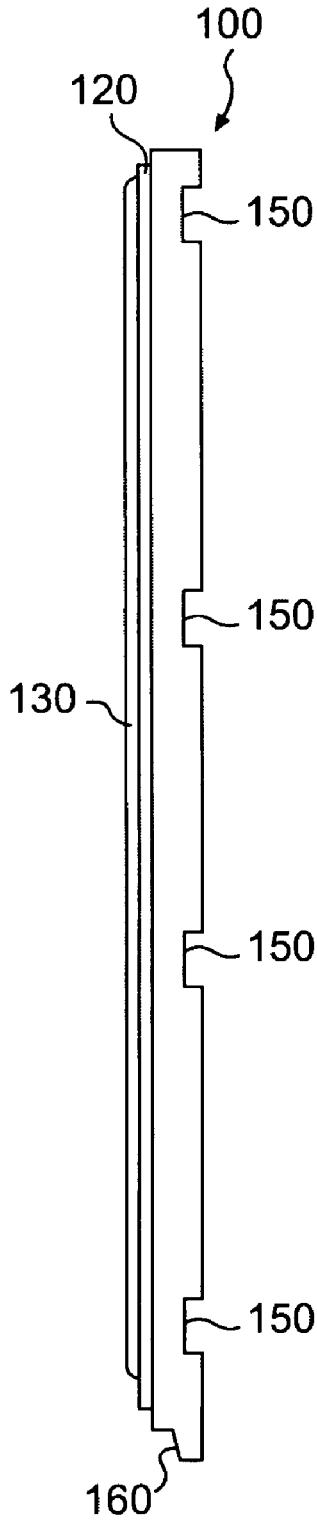
FIG. 2 is a side view of an insulated door consistent with one embodiment of the invention.
Figure 3:
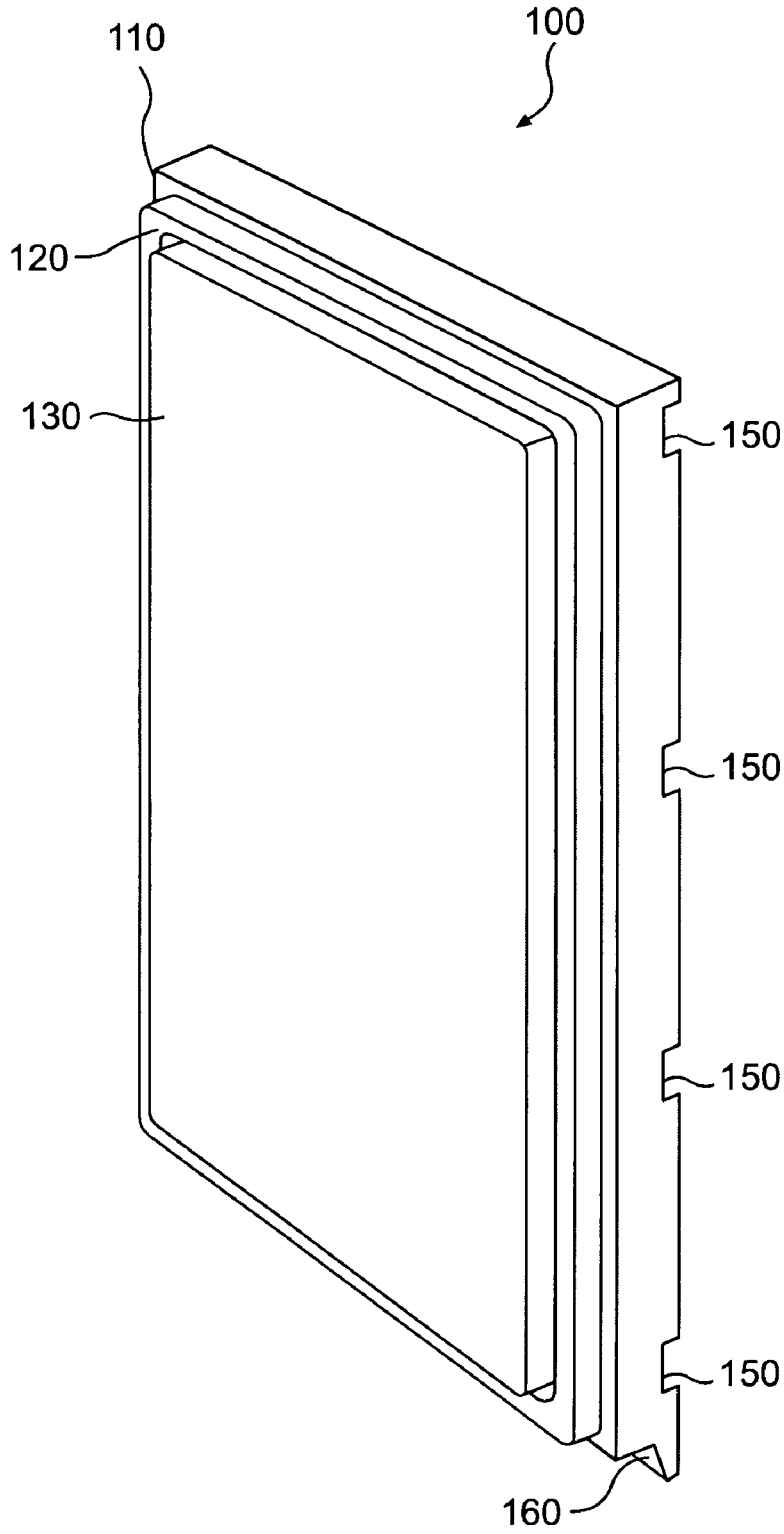
FIG. 3 is a perspective view of an insulated door consistent with one embodiment of the invention.
Figure 4:
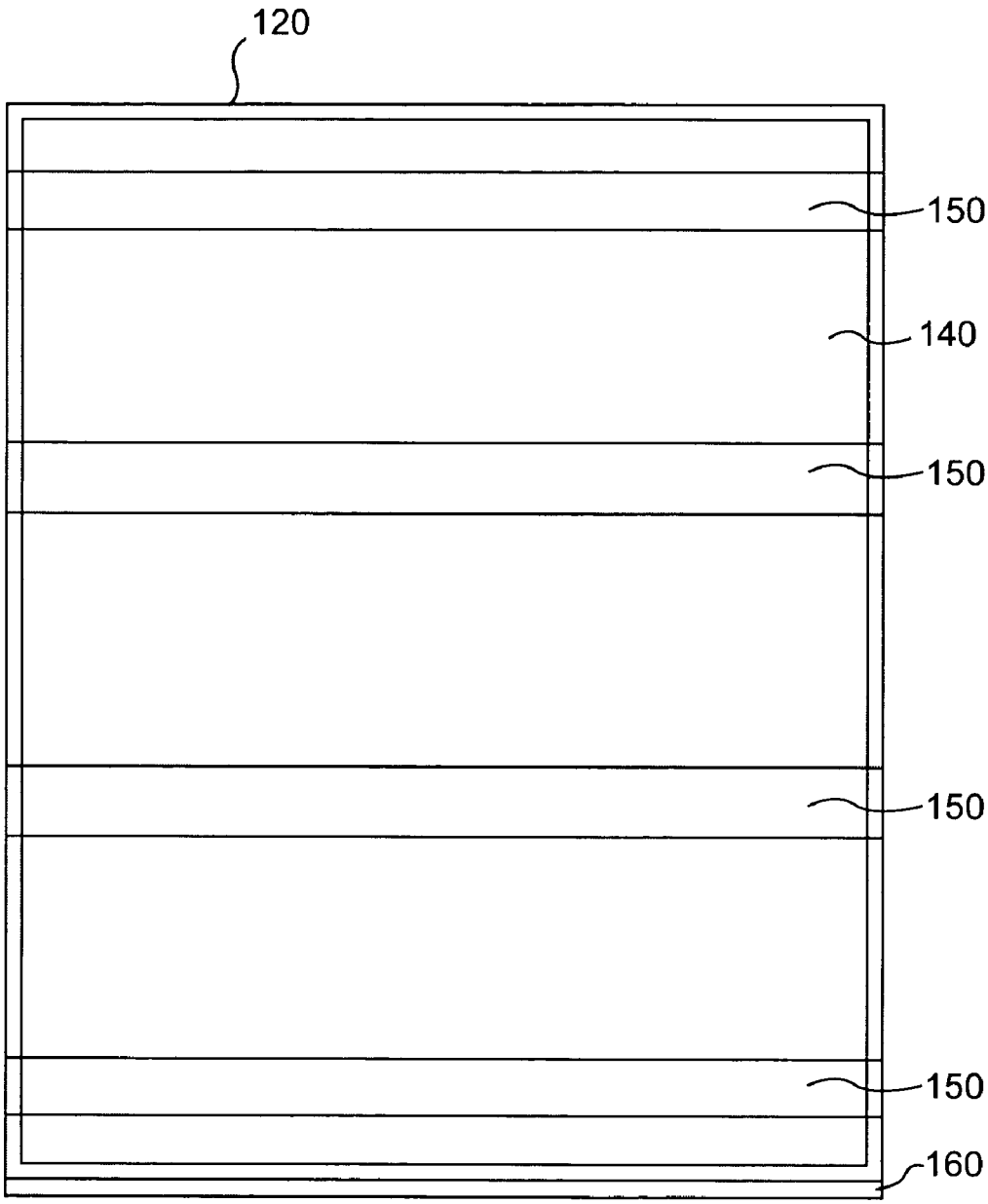
FIG. 4 is a rear view of an insulated door consistent with one embodiment of the invention.
Figure 5:
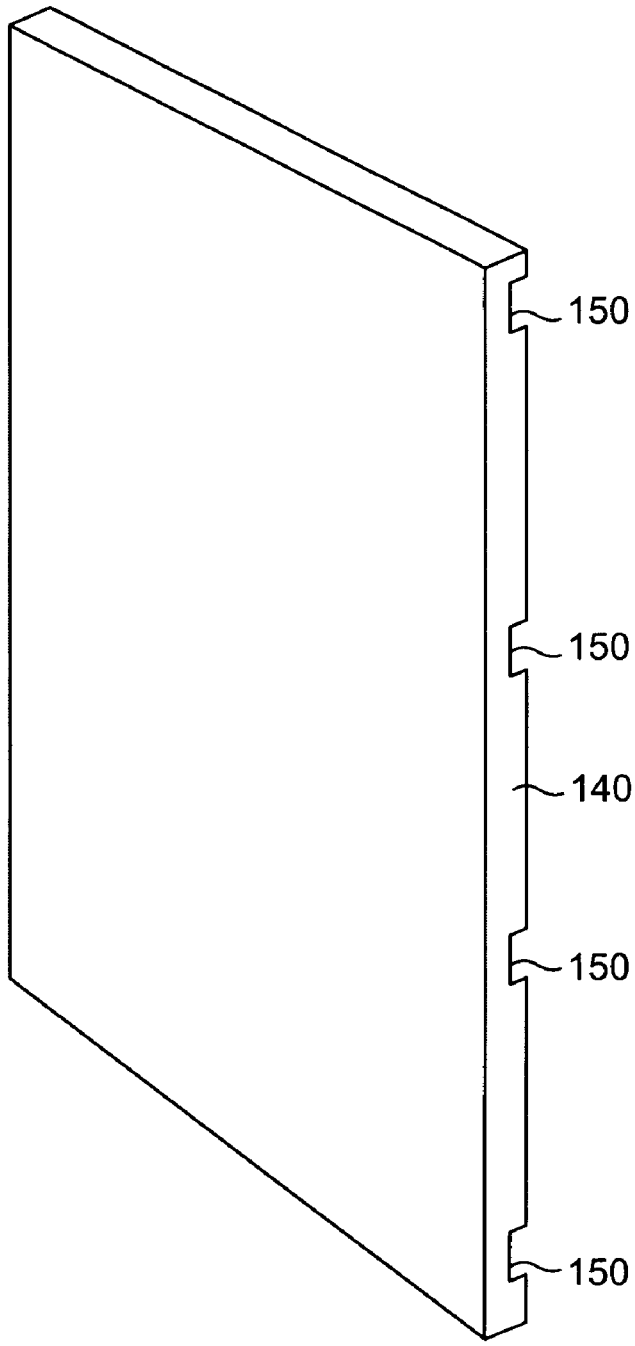
FIG. 5 is a perspective view of a door consistent with one embodiment of the invention.

Door 140 is used to either close off or provide access to a door opening of a boxcar depending on whether door 140 is opened or closed. FIG. 5 is a perspective view of a door consistent with one embodiment of the invention. Door 140 may be a door of an existing boxcar or it may be a newly constructed door for installation in a boxcar. In one implementation, door 140 is constructed of materials comprising galvanized steel, aluminum, stainless steel, fiber-reinforced plastics, removable plastic films or some combination of these materials. In addition, door 140 may be constructed in any shape suitable to close off a door opening of a boxcar. In one implementation, for example, door 140 is a plug door. Door 140 may also include additional features, such as indentations 150, handles (not shown) or locks (not shown) that may typically be found on a door. These implementations are merely exemplary and other implementations may also be used.

Figure 6:
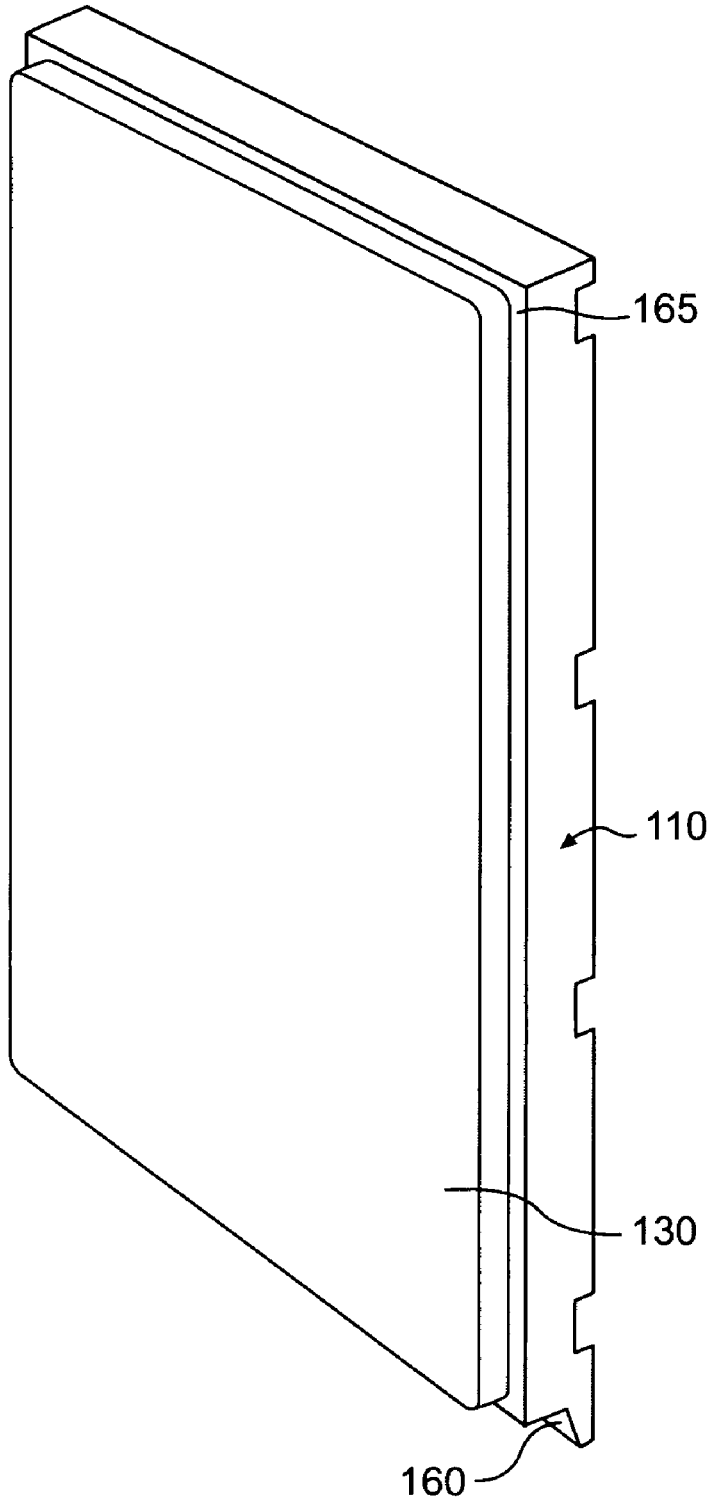
FIG. 6 is a perspective view of a liner consistent with one embodiment of the invention.

Liner 110 insulates door 140 in order to prevent heat loss. As described above, liner 110 is attached to a surface of door 140. FIG. 6 is a perspective view of a liner consistent with one embodiment of the invention. In one implementation, liner 110 is attached to the surface of door 140 facing inward toward the enclosure to which door 140 will provide access (the interior surface of door 140). In other implementations, liner 110 will be attached to the surface of door 140 opposing this interior surface (the exterior surface of door 140). In another implementation, liner 110 will also be attached to other surfaces of door 140 such as the side surfaces of door 140. As shown in FIGS. 1-4, in this implementation, liner 110 partially surrounds door 140 including the interior, top, bottom, and side surfaces of door 140. In another implementation, liner 110 will partially cover only the interior surface of door 140. In still another implementation, liner 110 will cover the interior surface of door 140 and only partially cover any other surfaces of door 140. In yet another implementation, liner 110 will completely surround all surfaces of door 140. Liner 110 may be attached to door 140 using any suitable method, such as adhesives, welding, mechanical fasteners, or any combination of these methods. These implementations are merely exemplary and other implementations may also be used.

Liner 110 may be constructed of materials comprising galvanized steel, aluminum, stainless steel, fiber-reinforced plastics, removable plastic films or some combination of these materials. In addition, liner 110 may be constructed in any suitable shape. In one implementation, liner 110 will include corrugations to improve the thermal efficiency of insulated door 100 by altering the air flow over liner 110. In another implementation, liner 110 will be constructed as a single piece using composite pultrusion. These implementations are merely exemplary and other implementations may also be used.

Figure 7:
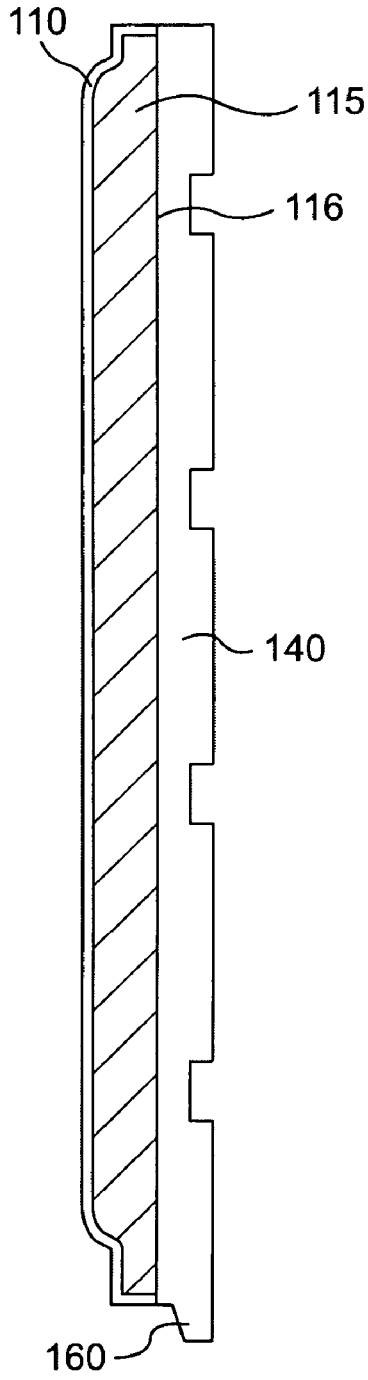
FIG. 7 is an illustrative cross-section of an insulated door with an insulation layer consistent with one embodiment of the invention.

In another implementation, liner 110 will also include an insulation layer to further improve the thermal efficiency of insulated door 100. FIG. 7 is an illustrative cross-section of an insulated door with an insulation layer consistent with one embodiment of the invention. In one implementation, liner 110 completely surrounds insulation layer 115. In another implementation, as shown in FIG. 7, insulation layer 115 will be applied directly to door 140 and liner 110 will be applied over insulation layer 115. These implementations are merely exemplary and other implementations may also be used.

Insulating layer 115 may be constructed from any insulating material that will increase the thermal efficiency of insulated door 100. In one implementation, insulating layer 115 comprises a closed-cell polymer foam, such as urethane. In another implementation, insulating layer 115 comprises a vacuum insulated panel. Vacuum insulated panels are constructed of an intermediate film or laminate providing a barrier to passage of air into an interior porous insulating material that has been evacuated to increase its insulating value. In one implementation, the interior porous insulating material comprises a micro-cellular open-cell foam core material. In one implementation, the diameter of the cells is on the order of $10^{-6}$ in. A one inch thick sheet of such a material may have a R-value (evacuated) of approximately 28. A micro-cellular, open-cell polystyrene foam, such as Instill™ available from Dow Chemicals may be used in such an implementation. In yet another implementation, the porous insulating material is a fine fiberglass web core material. In one implementation, each fine fiberglass strand will have a diameter of approximately 0.001 in. A one inch thick sheet of such a material may have a R-value (evacuated) of approximately 40. A fine fiberglass web core material such as Threshold™ available from Thermal Visions may be used in such an implementation. In another implementation, insulation layer 115 comprises a combination of foam and vacuum insulated panels. These implementations are merely exemplary, and other implementations may be used.

In one implementation, if multiple pieces of insulating material are used to form insulating layer 115, these pieces will not be adhered to one another but will be sized to fit snugly between door 140 and liner 110. Thus, insulating layer 115 will not include the thermal shorts of the prior art discussed above. In another implementation, as shown in FIG. 7, a plastic film 116 will be included on door 140 against insulating layer 115. Plastic film 116 will assist in attaching liner and insulating layer 115 to door 140. These implementations are merely exemplary, and other implementations may be used.

In another implementation, as shown in FIGS. 1-3, and 6, liner 110 will also include a protruding portion 130. Protruding portion 130 allows for the inclusion of a larger insulating layer 115, as shown in FIG. 7. Protruding portion 130 is not necessary to include an insulating layer, and if included, the size of protruding portion 130 may be varied. These implementations are merely exemplary and other implementations may also be used.

Gasket 120 provides for a seal when insulated door 100 is closed. As described above, gasket 120 is located on the perimeter of the interior surface of liner 110. When insulated door 100 is closed, gasket 120 will be compressed against a door jamb (described below) in a door opening thereby reducing air flow into the boxcar, which would decrease the thermal efficiency of the car. In one implementation, gasket 120 will provide a substantially airtight seal when insulated door 100 is closed. These implementations are merely exemplary and other implementations may also be used.

Gasket 120 may be constructed of any compressible material, such as rubber. In addition, gasket 120 may be attached to liner 110 using any suitable method including adhesives, mechanical fasteners, or a combination of these methods. In one implementation, wherein liner 110 includes a protruding portion 130, gasket 120 will be constructed to fit around protruding portion 130. These implementations are merely exemplary and other implementations may also be used.

A boxcar door consistent with the invention will be installed in a door opening in a boxcar. Typically, the door opening will include a door jamb, which surrounds the perimeter of the door opening. When the boxcar door is closed, it typically contacts the door jamb. In some instances, the point or points of contact between the door jamb and the door may act as a thermal short, that is, an area where heat loss could occur more easily.

In order to address this problem, in one implementation, as shown in FIGS. 1-3, 6, and 9, liner 110 will also include a wedge portion 160 on its bottom edge. In this implementation, wedge portion 160 has a sloping face that will mate with a sloping face of a wedge portion of a door jamb (described below). When insulated door 100 is closed wedge portion 160 will mate with the wedge portion of the door jamb and function as a thermal break. A thermal break is an area of low-heat conductivity that reduces the heat transfer between two elements. In this case, the wedge-shaped portion will reduce heat transfer between the door and the door jamb and thereby improve the thermal performance of insulated door 100.

Figure 8:
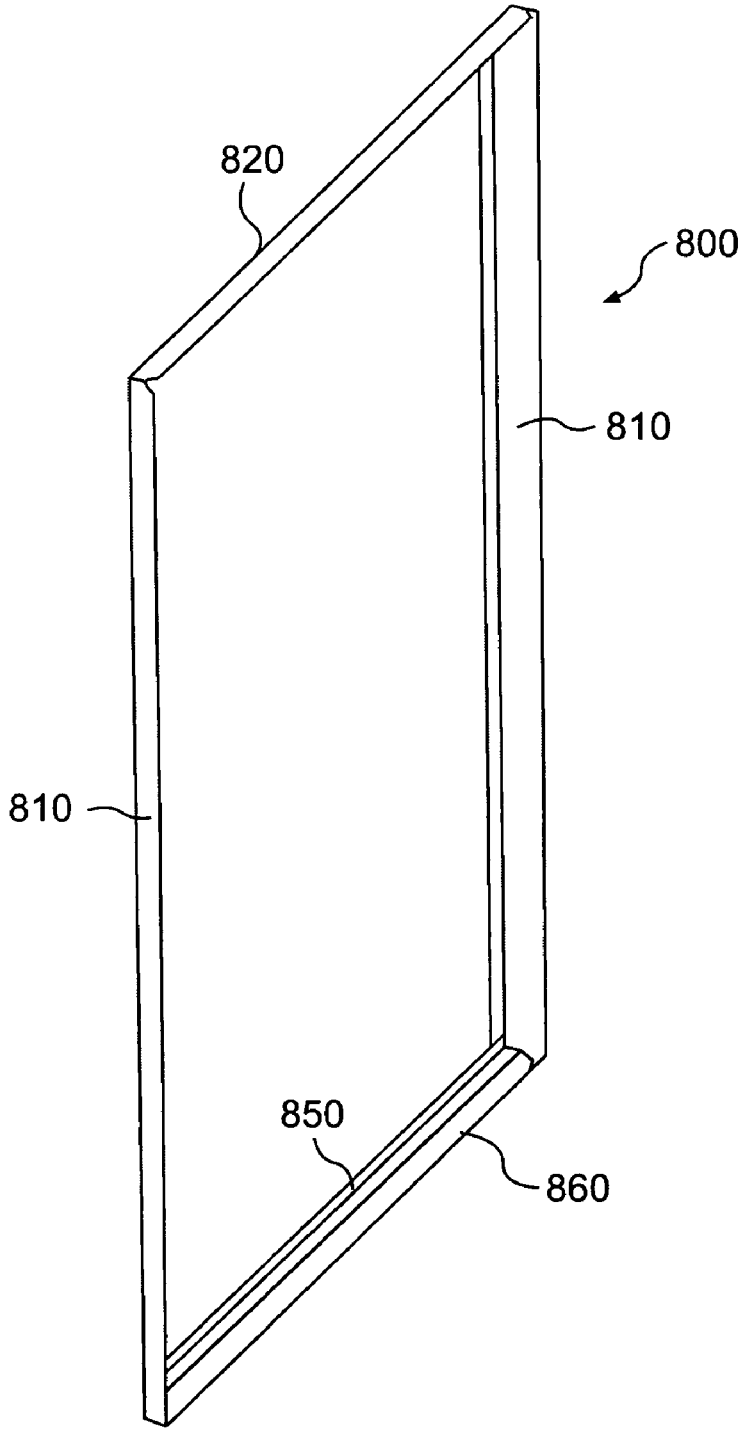
FIG. 8 is a perspective view of a door jamb consistent with one embodiment of the invention.
Figure 9:
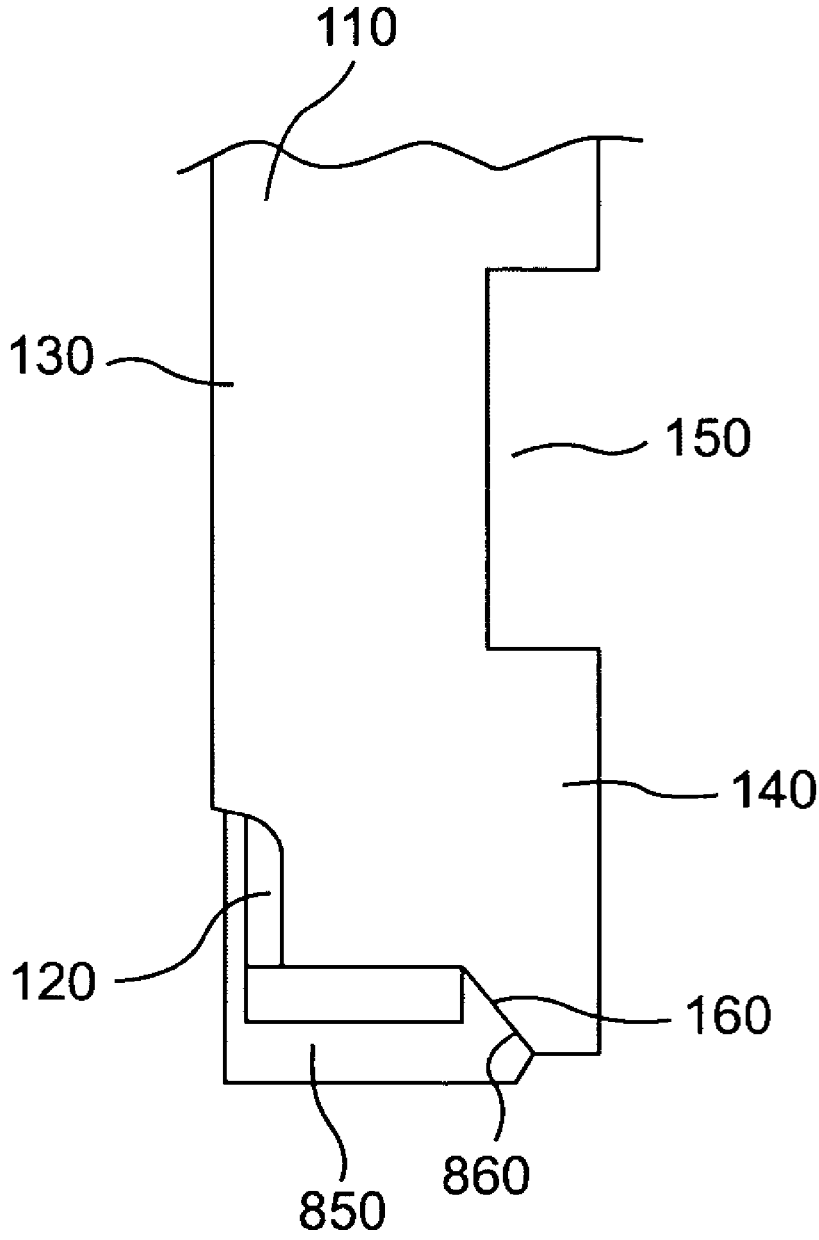
FIG. 9 is an illustration of portions of a boxcar door and door jamb consistent with one embodiment of the invention.

FIG. 8 illustrates a door jamb consistent with one embodiment of the invention and FIG. 9 illustrates portions of a boxcar door and door jamb consistent with one embodiment of the invention. As shown in FIG. 8, door jamb 800 comprises two side members 810, a top member 820, and a bottom member 850. Side members 810 are aligned vertically and are connected to the boxcar at opposing sides of the door opening in the boxcar. Top member 820 and bottom member 850 are aligned horizontally and are connected to the boxcar at the top and bottom opposing ends of the door opening in the boxcar. Side members 810, top member 820, and bottom member 850 are oriented and spaced such that they can receive the door in the area formed by the members. This implementation is merely exemplary and other implementations may also be used.

In one implementation, side members 810 and top member 820 have an L-shaped cross section suitable to receive the door. In side members 810 and top member 820, one leg of the "L" is aligned perpendicular to the interior surface of the door when the door is closed, while the other leg is aligned parallel to the interior surface of the door when the door is closed. This implementation is merely exemplary and other implementations may also be used.

In one implementation, bottom member 850 also has a generally L-shaped cross-section suitable to receive the door. As with the other door jamb members, in bottom member 850, one leg of the "L" is aligned perpendicular to the interior surface of the door while the other leg is aligned parallel to the interior surface of the door when the door is closed. In bottom member 850, as shown in FIG. 8-9, the perpendicular leg includes a wedge portion 860 suitable to mate with wedge portion 160 on liner 110. In one implementation, wedge portion 860 is sloped at a substantially similar angle to the sloped face of wedge portion 160 on liner 110. These implementations are merely exemplary and other implementations may also be used.

When the door is closed, wedge portion 160 on liner 110 will contact wedge portion 860 on bottom member 850 of door jamb 800. As described above, this will form a thermal break. In addition, gasket 120 will be compressed against side members 810, top member 820, and bottom member 850 of door jamb 800 to form an air seal. The combination of these elements will improve the thermal efficiency of insulated door 100.

It should be understood that an insulated door consistent with the invention will have improved thermal efficiency and that inclusion of such an insulated door in a cargo container will improve the thermal efficiency of a cargo container. It should also be understood that the invention could be used to modify a door of an existing cargo container or in the construction of a new cargo container. In addition, as indicated above, the method of the invention may be applied to other cargo containers, besides boxcars.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method of insulating a door of an existing cargo container, wherein the existing cargo container door is made substantially of materials other than composite materials, the method comprising:

adding a liner, comprising composite materials and having a first surface and a second surface opposing the first surface, to at least one surface of the existing cargo container door such that the liner substantially covers the surface of the door and the first surface of the liner is facing the door;

adding an insulating layer between the first surface of the liner and the surface of the door; and adding a gasket to the second surface of the liner.

2. The method as in claim 1, wherein the liner is attached using adhesives.

3. The method as in claim 1, wherein the liner is attached by welding.

4. The method as in claim 1, wherein the liner is attached using mechanical fasteners.

5. The method as in claim 1, wherein the liner completely surrounds the insulation layer.

6. The method as in claim 1, wherein the insulation layer is applied directly to the door.

7. The method as in claim 6, further comprising applying a plastic film between the door and the insulating layer.

8. The method as in claim 1, wherein the gasket is attached using adhesives.

9. The method as in claim 1, where in the gasket is attached using mechanical fasteners.

10. The method as in claim 1, further comprising constructing the liner substantially of composite materials.

11. The method as in claim 10, wherein the liner is constructed as a single piece using composite pultrusion.

* * * * *